US008404975B2

(12) United States Patent
Chang

(10) Patent No.: US 8,404,975 B2
(45) Date of Patent: Mar. 26, 2013

(54) CABLE STRUCTURE

(75) Inventor: Hsing-Wang Chang, Shenkeng Township, Taipei County (TW)

(73) Assignee: Taiwan Line Tek Electronic Co., Ltd., Taipei County (TW)

( * ) Notice: Subject to any disclaimer, the term of this patent is extended or adjusted under 35 U.S.C. 154(b) by 358 days.

(21) Appl. No.: 12/753,691

(22) Filed: Apr. 2, 2010

(65) Prior Publication Data

US 2011/0127063 A1 Jun. 2, 2011

(30) Foreign Application Priority Data

Nov. 27, 2009 (CN) ..... 2009 2 02730150 U

(51) Int. Cl.
*H01B 7/18* (2006.01)
*H01B 9/02* (2006.01)

(52) U.S. Cl. ..... 174/102 R; 174/93; 174/88 R; 174/105 R; 174/71 R; 174/71 C

(58) Field of Classification Search ..... 174/102 R, 174/105 R, 71 R, 71 C, 93, 88 R
See application file for complete search history.

(56) References Cited

U.S. PATENT DOCUMENTS 4,484,022 A * 11/1984 Eilentropp ..... 174/84 R
4,595,724 A * 6/1986 Koblitz ..... 524/409
4,751,350 A * 6/1988 Eaton ..... 174/87
5,360,945 A * 11/1994 Truesdale et al. ..... 174/151
5,696,351 A * 12/1997 Benn et al. ..... 174/92
7,985,924 B1 * 7/2011 Ruffa ..... 174/102 R

* cited by examiner

*Primary Examiner* — Jayprakash N Gandhi
*Assistant Examiner* — Dion Ferguson
(74) *Attorney, Agent, or Firm* — Guice Patents PLLC

(57) ABSTRACT

The present invention relates to a cable structure, comprises a cable having a first, a second and a third conductive wires made of metal wire material, the third conductive wire is covered by a third insulation layer, the first conductive wire is interlaced on the third insulation layer and is covered by a second insulation layer, the second conductive wire is interlaced on the second insulation layer and is covered by a first insulation layer; the second conductive wire and the second insulation layer are exposed at one end of the first insulation layer, and the first conductive wire and the third conductive wire covered by the third insulation layer are exposed out of the second insulation layer; and a positioning sleeve passes through the first conductive wire and the third conductive wire having the third insulation layer and is sleeved and riveted on the second insulation layer so that the positioning sleeve is clamped and fastened on the second insulation layer and is served to abut against a cut portion of the first insulation layer for preventing the second insulation layer from retreating into the first insulation layer so short circuit of the first and the second conductive wires is effectively avoided.

11 Claims, 8 Drawing Sheets

CABLE STRUCTURE

BACKGROUND OF THE INVENTION

1. Field of the Invention

The present invention relates to a cable structure, more particularly to a cable structure capable of preventing a second insulation layer from retreating into a first insulation layer.

2. Description of Related Art

A power cable is commonly seen in daily lives, for example being served to connect a round-column type power supply plug, and according to different diameters of power sockets of various electronic good, e.g. a notebook computer or mobile phone, the power supply plug may have different outer diameters. Or one end of the power cable is designed to be a strain relief (SR) of an electronic goods, e.g. a power adapter.

In view of the whole structure of the mentioned cable, the cable includes a metal anode conduction wire, a metal cathode conduction wire and a signal wire, wherein the metal anode and cathode conduction wires are metal interlacing wires without insulation layers, and the signal wire is covered by an insulation layer. In the processing formation period of the cable, the anode conduction wire is interlaced on the signal wire, then a layer of insulation material (a second insulation layer) is covered on the anode conduction wire, and the cathode conduction wire is interlaced on the insulation material, then another layer of insulation material (a first insulation layer) is covered on the cathode conduction wire, so as to complete the assembly of the cable.

If the mentioned cable is desired to be connected with a power supply plug, a portion of the first insulation layer is firstly peeled so the second insulation layer and the cathode conduction wire are exposed; then a portion of the second insulation layer is peeled so the anode conduction wire and the signal wire are exposed, and a heat shrinkable sleeve is respectively installed on the anode conduction wire and the cathode conduction wire and the heat shrinkable sleeve is processed with a heating treatment, so that front portions of the anode and the cathode conduction wires and the signal wire are able to be welded on corresponding positions of the power supply plug, then the cable and the power supply plug are processed with an injection covering operation, so the finished goods of the power supply plug is provided with functions of transferring DC power and signals.

The concerned disadvantage of the mentioned cable is that, when the cable is being used, the second insulation layer retreats toward the first insulation layer due to the pull or swing movement done by users, but the heat shrinkable sleeve installed at the exterior of the anode conduction wire does not retreat with the second insulation layer, so the anode conduction wire inside the second insulation layer is exposed and may cause short circuit with the cathode conduction wire. So how to prevent the second insulation layer from retreating into the first insulation layer is needed to be solved.

SUMMARY OF THE INVENTION

One primary object of the present invention is to provide a cable structure, a second insulation layer installed at exterior of a cut portion of a first insulation layer of the cable is connected, e.g. being riveted, with a positioning sleeve so as to overcome disadvantages of the second insulation layer retreating into the first insulation layer.

One another object of the present invention is to provide a cable structure in which a positioning sleeve is provided for increasing the insulation distance between an anode and a cathode conduction wires and is able to effectively avoid short circuit of the anode and the cathode conduction wires.

For achieving the mentioned objects, one solution provided by the present invention is to provide a cable structure, comprises:

a cable having a first, a second and a third conductive wires made of metal wire material, the third conductive wire is covered by a third insulation layer, the first conductive wire is interlaced on the third insulation layer and is covered by a second insulation layer, the second conductive wire is interlaced on the second insulation layer and is covered by a first insulation layer; the second conductive wire and the second insulation layer are exposed at one end of the first insulation layer, and the first conductive wire and the third conductive wire covered by the third insulation layer are exposed out of the second insulation layer; and a positioning sleeve, which is a metal ring, the metal ring passes through the first conductive wire and the third conductive wire having the third insulation layer and is sleeved and riveted on the second insulation layer so that the metal ring is clamped and fastened on the second insulation layer and is served to abut against a cut portion of the first insulation layer for preventing the second insulation layer from retreating into the first insulation layer.

Another solution provided by the present invention is to provide a cable structure, comprises:

a cable having a first, a second and a third conductive wires made of metal wire material, the third conductive wire is covered by a third insulation layer, the first conductive wire is interlaced on the third insulation layer and is covered by a second insulation layer, the second conductive wire is interlaced on the second insulation layer and is covered by a first insulation layer; the second conductive wire and the second insulation layer are exposed at one end of the first insulation layer, and the first conductive wire and the third conductive wire installed with the third insulation layer are exposed out of the second insulation layer; and a positioning sleeve, which is a metal ring provided with plastic material so as to form a plastic tube covering the metal ring, the metal ring installed inside the plastic tube passes through the second conductive wire and the third conductive wire having the third insulation layer and is sleeved and riveted on the second insulation layer so that the metal ring is clamped and fastened on the second insulation layer and the plastic tube is served to abut against a cut portion of the first insulation layer for preventing the second insulation layer from retreating into the first insulation layer.

DETAILED DESCRIPTION OF THE PREFERRED EMBODIMENT

Figure 1:
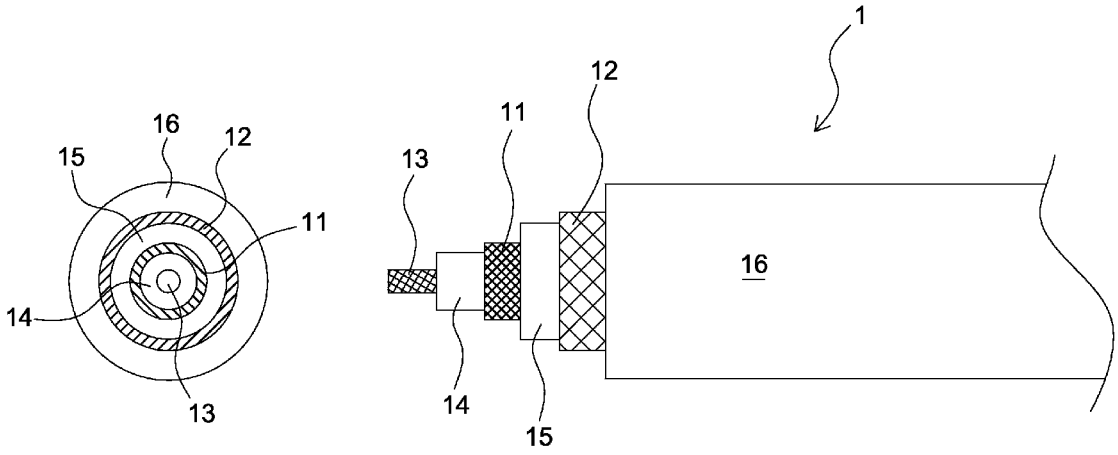
FIG. 1 is a schematic view of the cable structure of the present invention.
Figure 2:
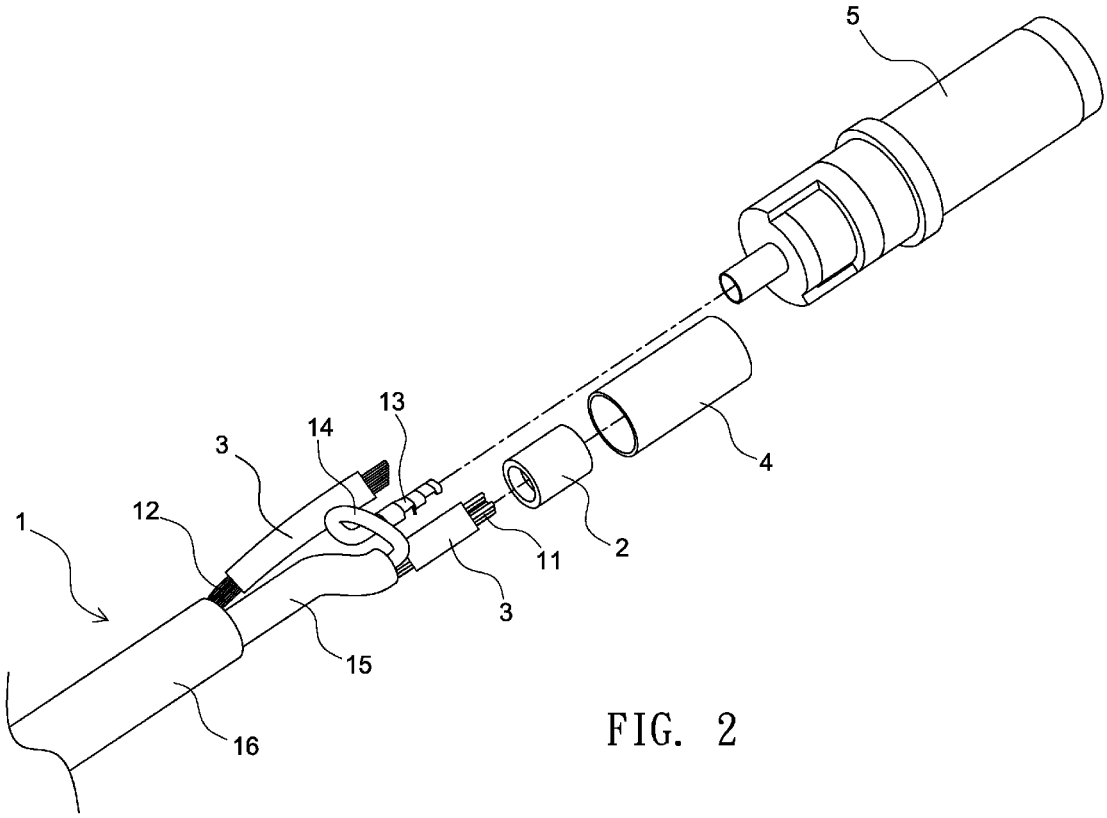
FIG. 2 is a perspective exploded view of the cable structure of the present invention and a power supply plug.
Figure 3:
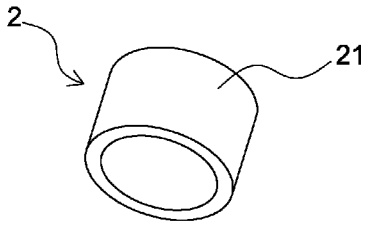
FIG. 3 is a perspective view of the positioning sleeve of one preferred embodiment of the present invention.

As shown in FIG. 1 and FIG. 2, the cable structure provided by the present invention is composed by a cable 1 and a positioning sleeve 2.

The cable 1 includes a first conductive wire 11 and a second conductive wire 12 respectively presenting anode and cathode electrodes; in practice the two conductive wires are metal interlacing wires with insulation layers, and the cable 1 is able to be further provided with a third conductive wire 13 according to actual needs, e.g. a signal wire, wherein the third conductive wire 13 is covered by a third insulation layer 14 so that the cable 1 is provided with functions of transferring positive and negative electricity and signals. As shown in FIG. 1, during the processing formation period of the cable 1, the first conductive wire 11 is installed on top of the third insulation layer 14 of the third conductive wire 13, then the first conductive wire 11 is covered by a second insulation layer 15, the second conductive wire 12 is installed on top of the second insulation layer 15, and a first insulation layer 16 is installed on top of the second conductive wire 12, so the assembly of the cable is finished and the first and the second conductive wires 11, 12 are separated by the second insulation layer 15 so as to avoid the possibility of short circuit.

When one end of the cable 1 is desired to be connected to a power supply plug, a portion of the first insulation layer 16 is peeled so the second insulation layer 15 and the second conductive wire 12 are exposed; then a portion of the second insulation layer 15 is peeled so the first conductive wire 11 and the signal wire 13 are exposed, front portions of the first and the second conducive wires 11, 12 are respectively sleeved with a heat shrinkable sleeve 3, and the two shrinkable sleeves 3 are processed with a heating treatment so as to form the cable shown in FIG. 2.

Figure 4A:
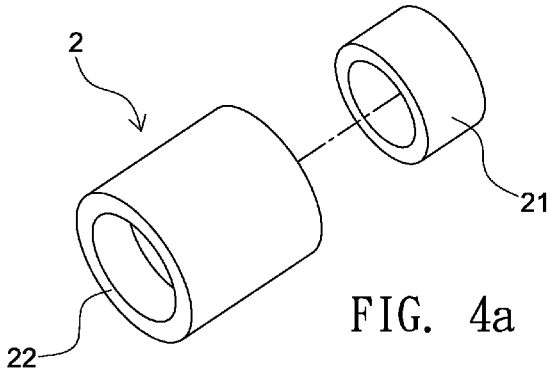
FIG. 4*a* is a perspective exploded view of the positioning sleeve of another preferred embodiment of the present invention.
Figure 4B:
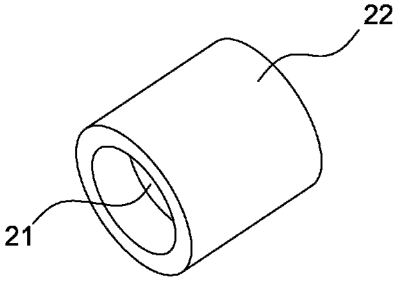
FIG. 4*b* is a perspective assembly view of the positioning sleeve of another preferred embodiment of the present invention.
Figure 4C:
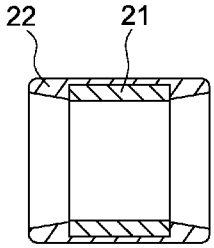
FIG. 4*c* is a perspective sectional assembly view of the positioning sleeve of another preferred embodiment of the present invention.

As shown in FIG. 2, FIG. 3, and FIG. 4*a* to FIG. 4*c*, the positioning sleeve 2 can be a rivet member; as shown in FIG. 2 the positioning sleeve 2 is a metal ring 21, e.g. a copper ring; or as shown from FIG. 4*a* to FIG. 4*c*, the positioning sleeve 2 is a metal ring, e.g. a copper ring, provided with plastic material, e.g. polyamide made by DuPont under the trademark of Nylon or other plastic materials, so as to form a plastic tube 22 covering the metal ring 21.

Figure 5:
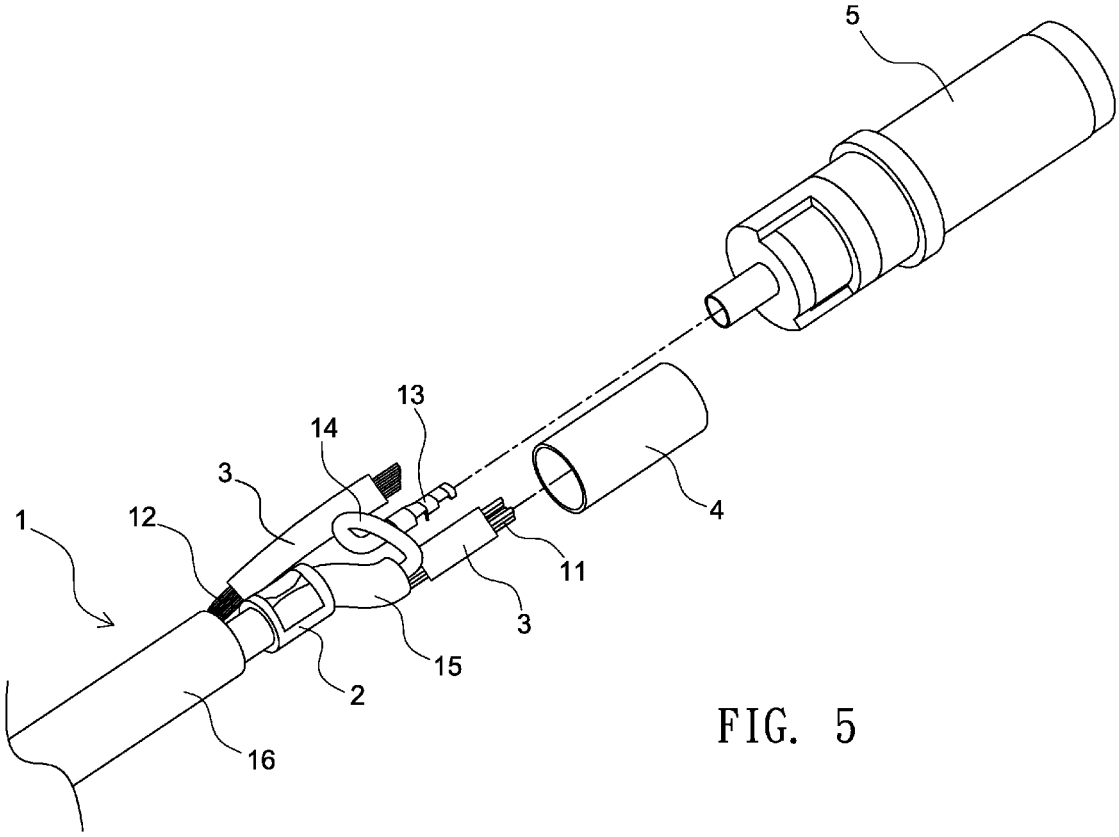
FIG. 5 is a schematic view illustrating the positioning sleeve shown in FIG. 2 being connected to the second insulation layer of the cable.

As shown in FIG. 5, the positioning sleeve 2, e.g. the metal ring 21 or the plastic tube 22 covering the metal ring 21, passes through the signal wire 13 and the first conductive wire 11, and is sleeved and fastened, e.g. being riveted, on the second insulation layer 15, so that the metal ring 21 is clamped and fastened on the second insulation layer 15 and the positioning sleeve 2 is prevented from moving on the second insulation layer 15.

Figure 6:
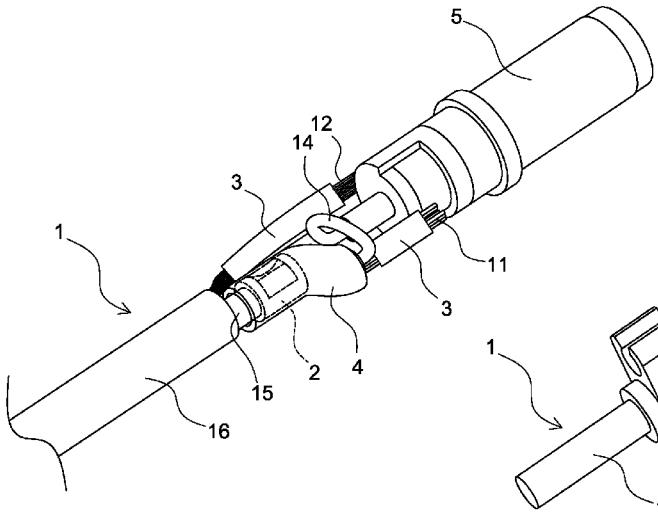
FIG. 6 is a perspective view illustrating the positioning sleeve shown in FIG. 2 being assembled with the power supply plug.

The present invention is further provided with an auxiliary adhesive heat shrinkable sleeve 4 installed at exteriors of the positioning sleeve 2 and the second insulation layer 15. As shown in FIG. 6, the auxiliary adhesive heat shrinkable sleeve 4 is heated and shrunk so as to cover the positioning sleeve 2 and the second insulation layer 15.

Figure 7:
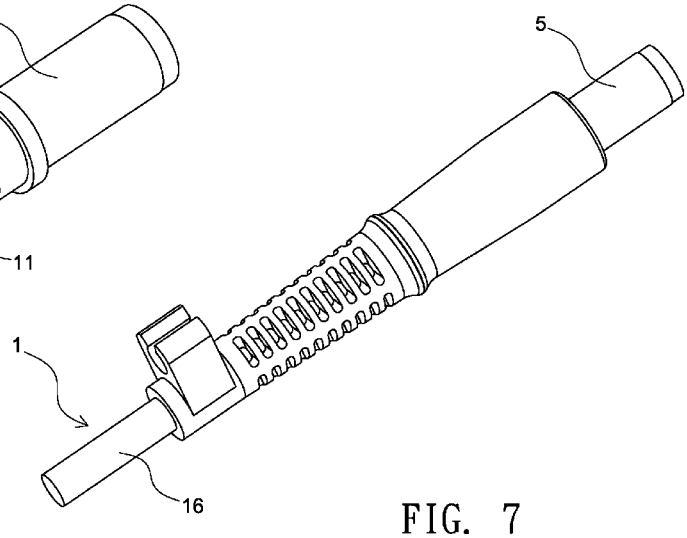
FIG. 7 is perspective view of one finished goods obtained by the cable structure and the power supply plug being processed with an injection covering treatment.

As shown in FIG. 6, the first, the second conductive wires 11, 12 and the signal wire 13 of the cable 1 of the present invention are welded on corresponding positions of a power supply plug 5, so that the cable 1 and the power supply plug 5 are firmly connected. Then the cable 1 and the power supply plug 5 are processed with a plastic injection operation so that the finished product of the power supply plug as shown in FIG. 7 is provided with functions of transferring DC power and signals.

Figure 8:
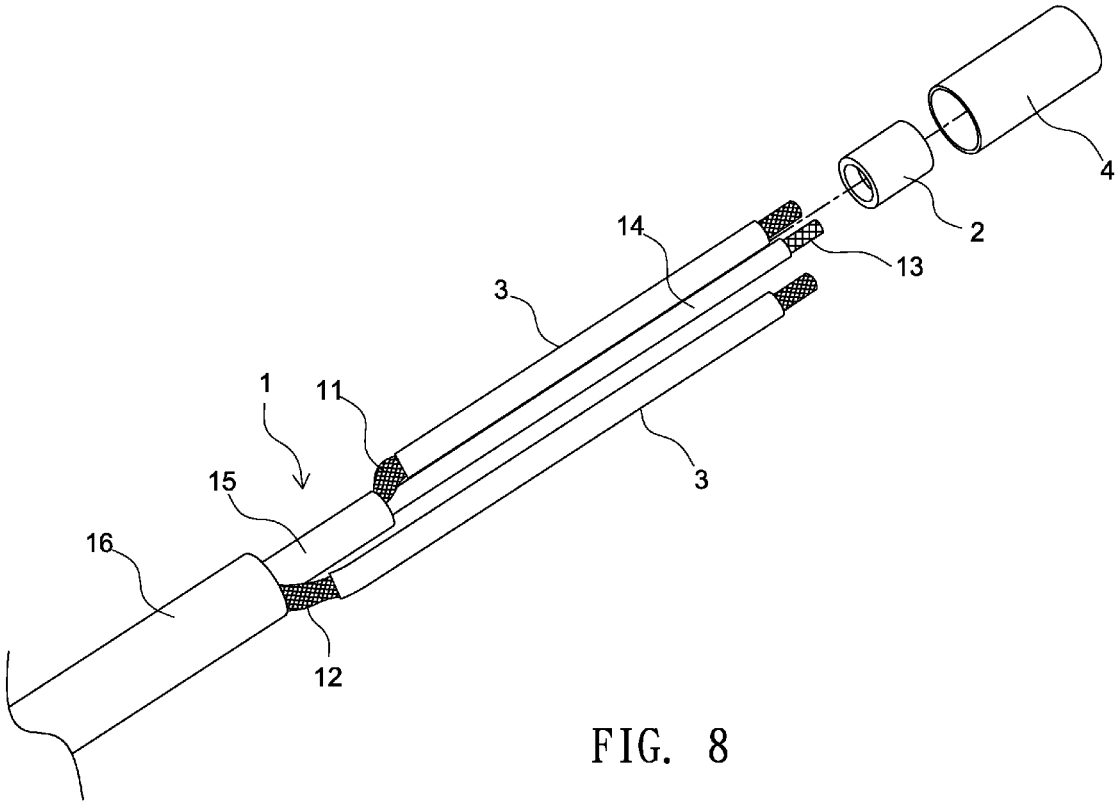
FIG. 8 is a perspective exploded view illustrating the cable structure of the present invention being served as a strain relief.

Referring to FIG. 8, which is a schematic view illustrating the cable structure of the present invention being served as a strain relief; a portion of the first insulation layer 16 is firstly peeled so the second insulation layer 15 and the second conductive wire 12 are exposed; then a portion of the second insulation layer 15 is peeled so the first conductive wire 11 and the signal wire 13 are exposed; an elongated heat shrinkable sleeve 3 is respectively installed on the first conductive wire 11 and the second conductive wire 12 and the two heat shrink sleeves 3 are processed with a heating treatment for forming the cable as shown in FIG. 8.

Figure 9:
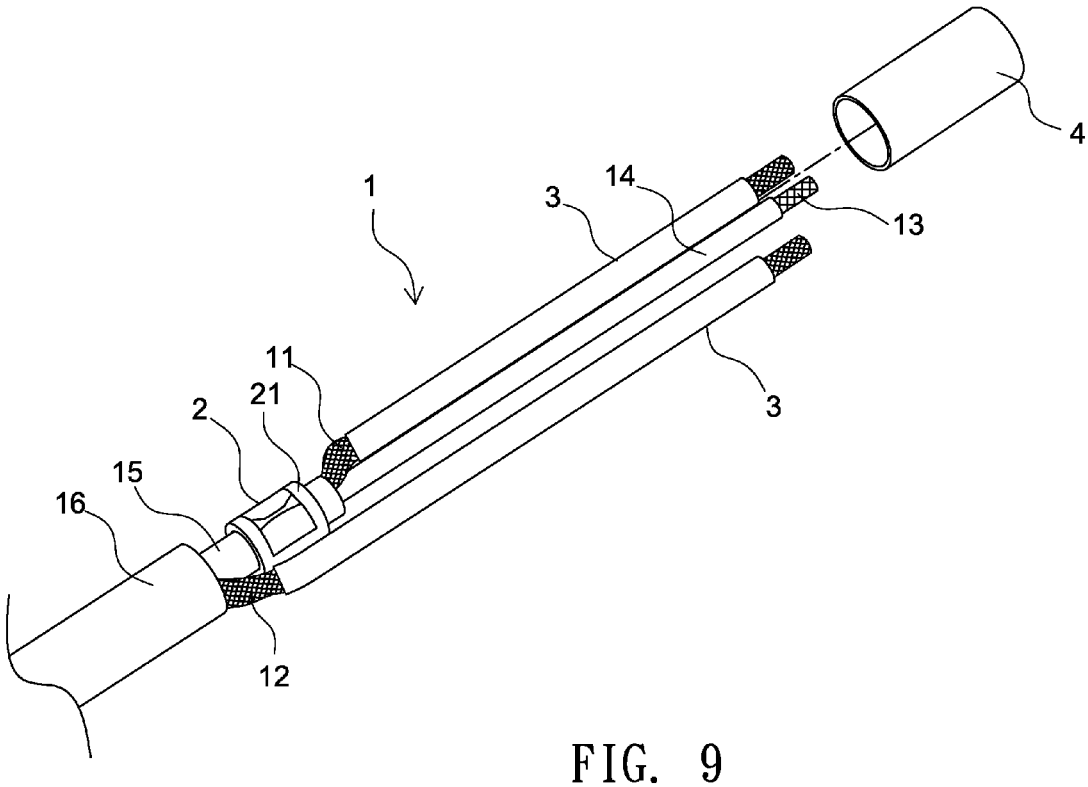
FIG. 9 is a schematic view illustrating the positioning sleeve shown in FIG. 8 being connected to the second insulation layer of the cable.

Referring to FIG. 9, the positioning sleeve 2, e.g. the metal ring 21 or the plastic tube 22 covering the metal ring 21, passes through the signal wire 13 and the first conductive wire 11, and is sleeved and fastened, e.g. being riveted, on the second insulation layer 15, so that the metal ring 21 is clamped and fastened on the second insulation layer 15 and the positioning sleeve 2 is prevented from moving on the second insulation layer 15.

Figure 10:
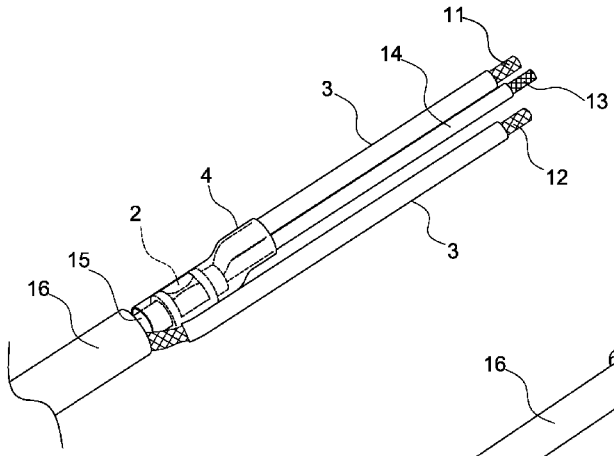
FIG. 10 is a perspective view illustrating the assembly of the cable structure shown in FIG. 8.

Referring to FIG. 10, the auxiliary adhesive heat shrinkable sleeve 4 is installed at exteriors of the positioning sleeve 2 and the second insulation layer 15. The auxiliary adhesive heat shrinkable sleeve 4 is heated and shrunk so as to cover the positioning sleeve 2 and the second insulation layer 15.

Figure 11:
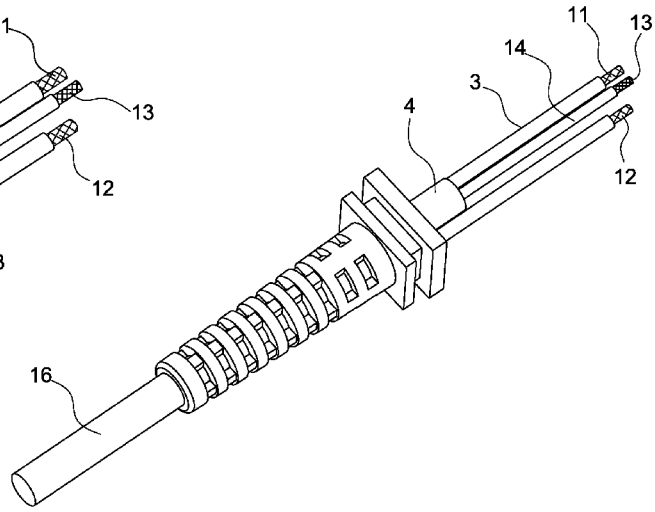
FIG. 11 is a perspective view of one finished goods obtained by the cable structure being processed with an injection covering treatment so as to serve as a strain relief.

As shown in FIG. 11, a cut portion of the first insulation layer 16 is processed with an operation of strain relief injection, and the first and the second conductive wires 11, 12 and the signal wire 13 are welded on a circuit board installed in the interior of a power supply device.

According to the mentioned preferred embodiment of the present invention, the advantages provided are as followings: regardless the end portion of the cable structure is served to be connected to a power supply plug or served as a strain relief, when the cable is pulled or swung, the second insulation layer of the cable retreats into the first insulation layer, when the metal ring or the plastic tube covering the metal ring of the positioning sleeve is in contact with the cutting portion of the first insulation layer, the positioning sleeve abuts against the first insulation layer so the second insulation layer no longer retreats into the first insulation layer, so that an object of preventing the second insulation layer from retreating into the first insulation layer is achieved.

Moreover, the auxiliary adhesive heat shrinkable sleeve is provided for increasing the insulation distance between the first and the second conductive wires, so the first and the second conductive wires are prevented from being short circuit, the auxiliary adhesive heat shrinkable sleeve not only enhances the insulation effect but also further prevents the second insulation layer from retreating into the first insulation layer; so the cable structure of the present invention is able to reduce rejection rate and ensures the quality stability, therefore the present invention is novel regarding related arts.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable structure comprising:

a cable having a first, a second and a third conductive wires made of metal wire material, said third conductive wire being covered by a third insulation layer, said first conductive wire being interlaced on said third insulation layer and being covered by a second insulation layer, said second conductive wire being interlaced on said second insulation layer and being covered by a first insulation layer; said second conductive wire and said second insulation layer being exposed at one end of said first insulation layer, and said first conductive wire, said third conductive wire and said third insulation layer covering said third conductive wire are exposed out of said second insulation layer; and a positioning sleeve, which being a metal ring, said first conductive wire and said third conductive wire installed with said third insulation layer are inserted through said metal ring and said metal ring is sleeved and riveted on said second insulation layer so that said metal ring being clamped and fastened on said second insulation layer and being served to abut against a cut portion of said first insulation layer for preventing said second insulation layer from retreating into said first insulation layer.

2. The cable structure as claimed in claim 1, wherein said first conductive wire is anode, said second conductive wire is cathode, and said third conductive wire installed with said third insulation layer is a signal wire.

3. The cable structure as claimed in claim 1, wherein further installed with an auxiliary adhesive heat shrinkable sleeve installed at exteriors of said positioning sleeve and said second insulation layer for covering said positioning sleeve and said second insulation layer.

4. The cable structure as claimed in claim 1, wherein said first and said second conductive wires are metal interlacing wires, and front portions thereof are respectively covered with a heat shrinkable sleeve.

5. The cable structure as claimed in claim 1, wherein said metal ring is a copper ring.

6. A cable structure comprising:

a cable having a first, a second and a third conductive wires made of metal wire material, said third conductive wire being covered by a third insulation layer, said first conductive wire being interlaced on said third insulation layer and being covered by a second insulation layer, said second conductive wire being interlaced on said second insulation layer and being covered by a first insulation layer; said second conductive wire and said second insulation layer being exposed at one end of said first insulation layer, and said first conductive wire, said third conductive wire and said third insulation layer covering said third conductive wire are exposed out of said second insulation layer; and a positioning sleeve, which being a metal ring provided with plastic material so as to form a plastic tube covering said metal ring, said metal ring installed inside said plastic tube, said second conductive wire and said third conductive wire installed with said third insulation layer are inserted through said metal ring and said metal ring is sleeved and riveted on said second insulation layer so that said metal ring being clamped and fastened on said second insulation layer and said plastic tube being served to abut against a cut portion of said first insulation layer for preventing said second insulation layer from retreating into said first insulation layer.

7. The cable structure as claimed in claim 6, wherein said first conductive wire is anode, said second conductive wire is cathode, and said third conductive wire installed with said third insulation layer is a signal wire.

8. The cable structure as claimed in claim 6, wherein further installed with an auxiliary adhesive heat shrinkable sleeve installed at exteriors of said positioning sleeve and said second insulation layer for covering said positioning sleeve and said second insulation layer.

9. The cable structure as claimed in claim 6, wherein said first and said second conductive wires are metal interlacing wires, and front portions thereof are respectively covered with a heat shrinkable sleeve.

10. The cable structure as claimed in claim 6, wherein the metal ring is a copper ring.

11. The cable structure as claimed in claim 6, wherein said plastic tube is polyamide or other plastic material.

* * * * *